United States Patent [19]

Villines

[11] 4,305,467

[45] Dec. 15, 1981

[54] BLOW-OUT PREVENTER LIFT SYSTEM AND METHOD

[75] Inventor: Douglas R. Villines, Weatherford, Okla.

[73] Assignee: Power Lift, Inc., Weatherford, Okla.

[21] Appl. No.: 168,293

[22] Filed: Jul. 14, 1980

[51] Int. Cl.[3] ..... E21B 19/02

[52] U.S. Cl. ..... 166/385; 166/85; 166/365; 254/227; 254/263; 254/280

[58] Field of Search ..... 166/315, 368, 365, 77, 166/77.5, 85; 254/380, 227, 263

[56] References Cited

U.S. PATENT DOCUMENTS

| | | | |
|---|---|---|---|
| Re. 26,290 | 10/1967 | Rand | 166/365 X |
| 468,644 | 2/1892 | Cornelius | 254/227 X |
| 2,358,096 | 9/1944 | Peterson | 254/172 |
| 2,984,455 | 5/1961 | Fischer | 254/172 |
| 3,021,909 | 2/1962 | Postlewaits | 166/315 X |
| 3,080,921 | 3/1963 | Lacy | 166/368 |
| 3,086,590 | 4/1963 | Jackson et al. | 166/368 X |
| 4,007,782 | 2/1977 | Nybo et al. | 166/79 |
| 4,125,164 | 11/1978 | Terry | 166/315 |

*Primary Examiner*—Ernest R. Purser

[57] ABSTRACT

An apparatus for lifting a blow-out preventer during oil or gas drilling operations includes a base frame which can be manually positioned atop the rotary table of the drilling platform of the drilling rig used to drill the well. The apparatus further includes a pair of winches which can be lowered to preselected positions on the base frame, after positioning the base frame on the rotary table, and secured to the base frame via pins that extend through clevises that are welded to the base frame and through apertured lugs that are welded to the winches and extend into the clevises. The blow-out preventer is lifted by the winches via cables that are wrapped on reels of the winches and passed through the base frame and rotary table to the blow-out preventer to which the cables are attached. The base frame comprises a U-shaped portion and an end beam, attachable to the U-shaped portion at the open end therof via pins, to permit positioning of the base frame on the rotary table at such times that drill pipes and the like extend through the rotary table.

15 Claims, 6 Drawing Figures

BLOW-OUT PREVENTER LIFT SYSTEM AND METHOD

BACKGROUND OF THE INVENTION

1. Field of the Invention

This invention relates generally to improvements in lifting devices and, more particularly, but not by way of limitation, to devices utilized to lift blow-out preventers during oil and gas well drilling operations.

2. Brief Description of the Prior Art

In the drilling of an oil or gas well, it is common for the drilling operation to be carried out from a drilling platform which forms a portion of the drilling rig and which is located some distance above the well proper; that is, the hole formed in the earth's surface by a drill. The drilling platform includes a rotary table which is mounted within a circular aperture in the floor formed by the drilling platform and means are provided for rotating the rotary table. The rotary table similarly has a central aperture and means are provided on the rotary table for gripping a drill string which extends through the rotary table so that the drill string can be rotated via the rotary table. The drill string is supported during drilling by a travelling block mounted on the drilling rig and positionable above the rotary table.

A casing, through which the drill string passes, is mounted in the well proper and it is common practice to bolt one or more blow-out preventers to the top of the casing, about the drill string, to close in the well should the drill penetrate a stratum in which gas is trapped under high pressure. These blow-out preventers are often massive structures; for example, blow-out preventers weighing in excess of 45 tons are used in drilling some wells. Such massive blowout preventers are also of considerable length, often extending from the casing to within a short distance of the bottom of the drilling platform.

At times, during the drilling of a well, it becomes necessary that operators of the drilling rig have access to the interior of the casing at the top of the casing. To provide access to the interior of the casing, at the top thereof, the blow-out preventer is unbolted from the casing and lifted therefrom. In some operations involving lifting of the blow-out preventer, the drill string will remain supported by the travelling block above the rotary table during the lifting operation and during the subsequent reattachment of the blow-out preventer to the casing.

In the past, it has been common practice to lift the blow-out preventer by means of hydraulic jacks suspended from the bottom of the drilling platform. The use of such jacks entails two serious problems. It is a time-consuming job to suspend the jacks from the drilling platform and connect the jacks to the blow-out preventer so that the job increases the cost of drilling a well. Moreover, the length of jacks suitable for lifting a massive blow-out preventer is not inconsiderable so that the attachment of the jacks to the blow-out preventer has, in the past, often been at lower portions of the blow-out preventer. The result is that the suspension of the blow-out preventer by jacks which, in turn, are suspended from the bottom of the drilling platform, is unstable. That is, the possibility exists that a blow-out preventer so suspended will topple to one side with considerable damage to drilling equipment and with considerable danger to persons working in the vicinity of the top of the casing.

It has also been common in the past to mount pulley systems, known as snatch blocks, to the underside of the drilling platform and lift a blow-out preventer via cables that pass from the blow-out preventer, through the snatch blocks, to winches mounted on trucks. The use of snatch blocks suffers from essentially the same two problems that make the use of jacks troublesome. It is a time consuming job to mount the snatch blocks and the entire system, once the lifting of the blow-out preventer commences, is unstable. A heavy blow-out preventer can result in the trucks being drawn toward the well rather than in the blow-out preventer being lifted. Since the blow-out preventer is unbolted from the well casing when the lifting commences, any movement of the trucks can result in toppling of the blow-out preventer. Thus, the use of snatch blocks and trucks leaves no room for error in blocking the trucks against movement. Thus, as with the use of jacks to lift a blow-out preventer, the use of snatch blocks is both time consuming and hazardous.

SUMMARY OF THE INVENTION

The present invention solves the problems that have existed with regard to the use of jacks and snatch blocks to lift blow-out preventers by providing a lifting apparatus which is readily positioned on the top of the drilling platform, on the rotary table, and which exerts a lifting force on upper portions of the blow-out preventer. To this end, the lifting apparatus of the present invention comprises a base frame, which can be manually positioned on the rotary table, and at least one winch which can be lowered on to the base frame after the base frame has been positioned on the rotary table. The winch is lowered into a preselected position on the base frame and the lifting apparatus further comprises a winch attachment means for pinning the winch to the base frame in such preselected position. The winch has a reel about which a cable can be wound and such cable is passed through the base frame and through the rotary table to attach to upper portions of the blow-out preventer. The winch can then be operated to lift the blow-out preventer. In a preferred form, the base frame has a U-shaped portion to which an end beam can be attached, at the open end of the U, to permit emplacement of the base frame at such times that a drill string extends through the rotary table.

Since the lifting apparatus is supported by the drilling platform, directly above the blow-out preventer, and since the lifting apparatus connects to upper portions of the blowout preventer, no instability exists in the mechanical system comprising the lifting apparatus and the suspended blow-out preventer.

An object of the present invention is to provide an apparatus and method for safely lifting a blow-out preventer.

Another object of the present invention is to provide an apparatus for lifting a blow-out preventer which can be rapidly and easiy emplaced on a drilling platform.

Still another object of the invention is to provide a blow-out preventer lifting apparatus which can be emplaced on a drilling platform and positioned on the rotary table thereof at such times that a drill string extends through the rotary table.

Other objects, features and advantages of the present invention will become apparent from the following detail specifications when read in conjunction with the attached drawings and appended claims.

BRIEF DESCRIPTION OF THE DRAWINGS

FIG. 6 is a schematic diagram of the hydraulic circuit used to operate the winches of a preferred embodiment of the lifting apparatus.

DESCRIPTION OF THE PREFERRED EMBODIMENT

Figure 1:
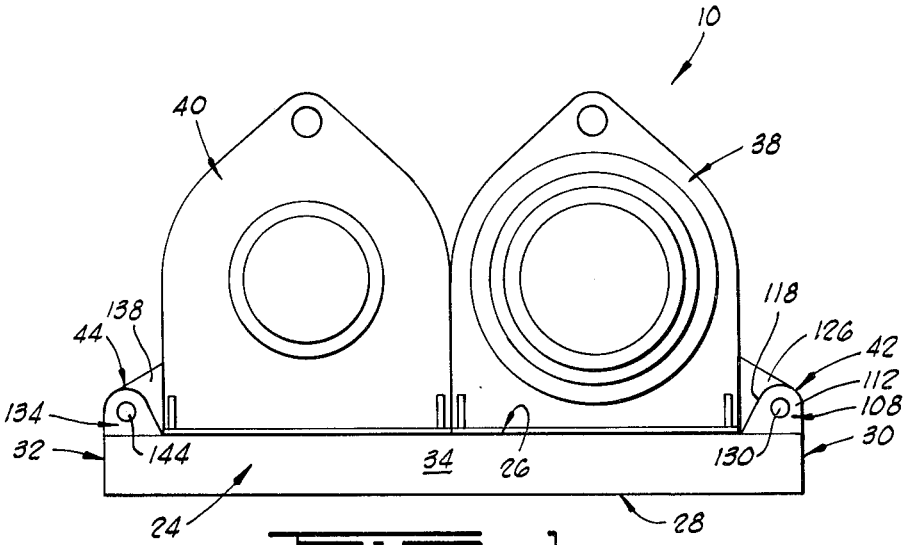
FIG. 1 is a side elevational view of a lifting apparatus constructed in accordance with the present invention.
Figure 2:
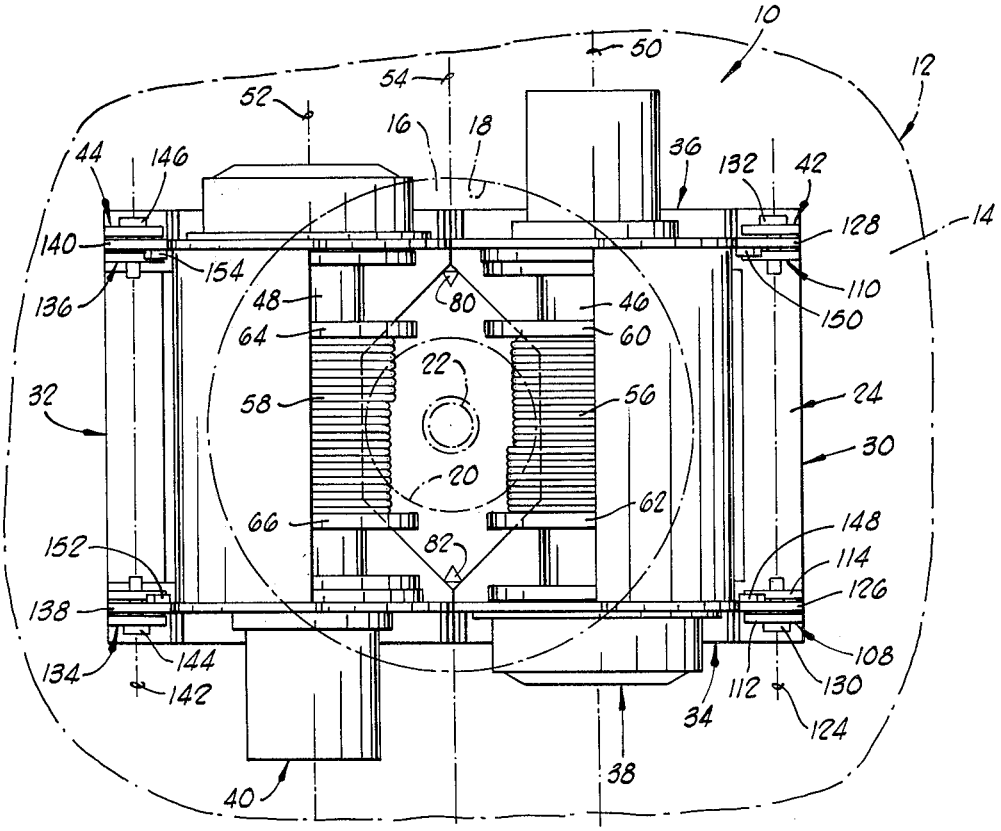
FIG. 2 is a plan view of the lifting apparatus.

Referring now to the drawings in general and to FIGS. 1 and 2 in particular, shown therein and designated by the general reference numeral 10 is a lifting apparatus constructed in accordance with the present invention. The lifting apparatus 10 is particularly adapted for lifting a blow-out preventer (not shown) from the casing (not shown) of an oil or gas well and, when used for this purpose the apparatus 10 is positioned on the drilling platform (generally indicated by the numeral 12 in FIG. 2 and partially shown therein in dot—dash lines) of the drilling rig used to drill the well. As is known in the art, the drilling platform 12 generally includes a floor-like structure 14 disposed some distance above the earth wherein the well is drilled and further includes a rotary table 16 mounted in an aperture 18 in the floor-like structure 14. The rotary table 16 has a central aperture 20 and is adapted to receive clamping devices (not shown) to clamp about a drill string or the like which passes through the drilling platform 12, through the blow-out preventer, and into the well. (The drill string has been represented by a drill pipe 22, drawn in dot-dash lines, in FIG. 2.) A mechanism (not shown) is provided to turn the rotary table 16 so that the drill string 22 can be rotated by clamping the drill string 22 to the rotary table 16 and rotating the rotary table 16. (For clarity of illustration, the rotary table 16 and the mounting thereof in the floor-like structure 14 has been indicated only schematically in FIG. 2. For purposes of the present disclosure, it will suffice to note that the apertured rotary table 16 is mounted within an aperture formed in the floorlike structure 14. The structural details of such mounting need not be considered for purposes of the present disclosure.)

FIG. 2 illustrates the preferred manner of positioning the lifting apparatus 10 for lifting a blow-out preventer from the casing for a well. As shown therein, the lifting apparatus 10 is supported by the drilling platform 12 to overlay portions of the aperture 18 formed in the floor-like structure 14 of the platform 12 and portions of the rotary table 16 and the aperture 20 formed therethrough. That is, the lifting apparatus 10 is preferably used with the rotary table 16 in place in the floor-like structure 14 and, in such use, the aperture 20 through the rotary table provides communication between spaces above and below the drilling platform 12. However, it will be understood that the apparatus 10 can be used with the rotary table 16 removed from the floor-like structure 14, in which case the aperture 18 provides communication between such spaces. Moreover, the use of the apparatus 10 is not limited to the lifting of blow-out preventers. Rather, the lifting apparatus 10 can be used to lift any load beneath any aperture formed through portions of the drilling platform 12 capable of supporting of the apparatus 10 and the load.

As shown in FIGS. 1 and 2, the lifting apparatus 10 generally comprises a base frame 24 which preferably has the general form of a flat, rectangular parallelepiped defined by: a top 26; a bottom 28; opposed first and second ends, 30 and 32 respectively; and opposed first and second sides, 34 and 36 respectively. As will be discussed in more detail below, the apparatus 10 is constructed to be assembled in situ and the apparatus 10 further comprises a first winch 38 which is disposed at a preselected position, atop the base frame 24 and adjacent the first end 30 thereof, in the assembled condition of the apparatus 10 shown in FIGS. 1 and 2. Similarly, the apparatus 10 comprises a second winch 40 which is disposed at a preselected position, atop the base frame 24 and adjacent the second end 32 thereof, in the assembled condition of the apparatus 10. The winches 38 and 40 are not directly attached to the base frame 24. Rather, in order to secure the winches 38, 40 to the base frame 24, the apparatus 10 further comprises a first winch attachment assembly 42, by means of which the first winch 38 is pinned to the base frame 24 in the preselected position of the first winch 38, and a second winch attachment assembly 44, by means of which the second winch 40 is pinned to the base frame 24 in the preselected position of the second winch 40. Thus, the attachment assemblies permit rapid assembly and disassembly of the apparatus 10 as will be discussed below.

While it will be clear from the discussion of the operation of the apparatus 10 to follow that the winches 38 and 40 can be of any type, the winches 38 and 40 are preferably hydraulically operated winches having a failsafe mode of operation. That is, the reels, 46 and 48, of the winches, 38 and 40 respectively, can be turned in either direction by pressurized hydraulic fluid transmitted to the winches 38, 40 as will be discussed below and the reels 46, 48 are locked in position at such times that the winches 38, 40 are not being hydraulically operated. Winches of this type are available from Lantec Industries Limited of Langley, British Columbia, Canada. Suitable winches for use in the present invention are identified by the model number 4135.

As has been shown in FIG. 2, the axes, 50 and 52, of the reels, 46 and 48 respectively, are disposed generally parallel to the ends 30, 32 of the base frame 24, in the preselected positions of the winches 38, 40, and the axes 50, 52 are offset toward the first and second ends, 30 and 32 respectively, of the base frame 24 from a central line 54 of the base frame 24. By means of this positioning of the reels 46 and 48 in the preselected positions of the winches 38 and 40, cables 56 and 58, disposed on the reels 46 and 48 respectively, can be raised and lowered along lines which are disposed within a limited distance of the center line of the base frame 54. The cable 56 is limited in side-to-side movement by flanges 60 and 62 mounted about central portions of the reel 46, between which flanges the cable 56 is wrapped on reel 46, and the cable 58 is similarly limited in side-to-side movement by flanges 64 and 66 mounted about central portions of the reel 48. The purpose of such limitations on the movement of the cables 56 and 58 will be discussed below.

Figure 3:
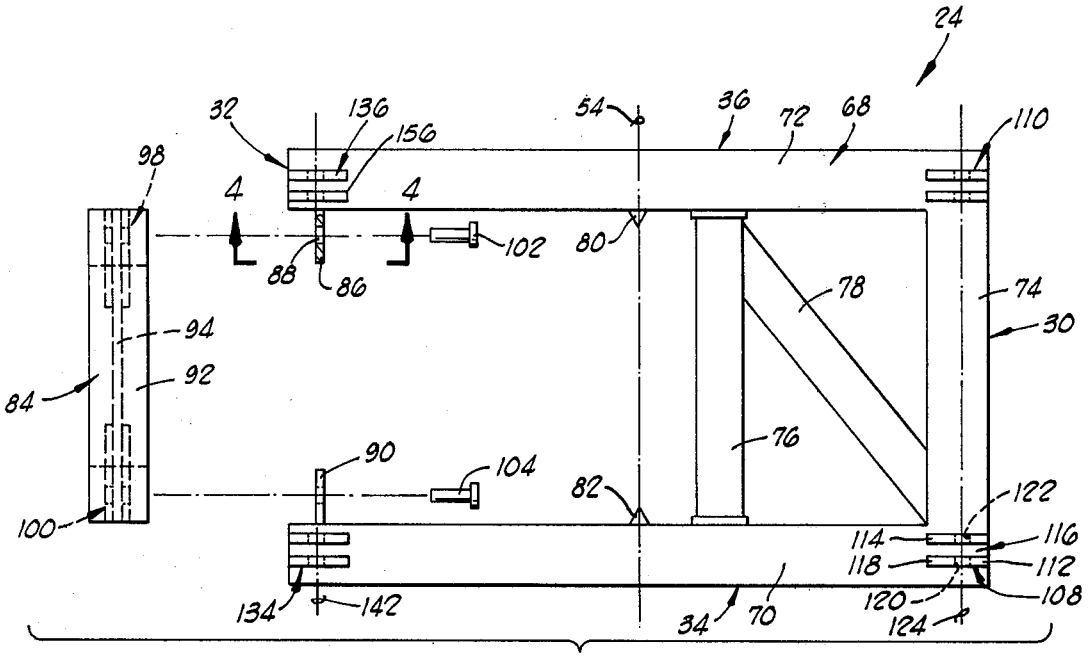
FIG. 3 is an exploded plan view of the base frame of the lifting apparatus.

The construction of the base frame 24 has been more particularly shown in FIGS. 3 through 5 and such construction will now be discussed with reference to these figures. FIG. 3 is an exploded plan view of the base frame 24 showing the elements which comprise the base frame 24. As shown therein, the base frame 24 has a U-shaped portion 68 comprising a first side beam 70, extending along the first side 34 of the base frame 24, and a parallel second side beam 72, extending along the second side 36 of the base frame 24. The side beams 70, 72 are preferably comprised of I-beams (not separately indicated in the drawings) and plates (not separately indicated in the drawings) which are welded along the lengths of the I-beams between the upper and lower webs of the I-beams. The side beams 70, 72 are positioned in the base frame 24 so that the plates form the sides 34 and 36 of the base frame 24. The ends of the side beams 70, 72 adjacent the first end of the base frame 24 are connected by a first end beam 74 which is welded to each of the side beams 70, 72 and extends therebetween along the first end 30 of the base frame 24. Thus, the side beams 70, 72 form the sides of the U and the first end beam forms the base thereof. The first end beam is preferably a length of I-beam having portions of the upper and lower webs of the ends thereof cut away so that the central web of the first end beam extends to the central webs of the I-beams of the side beams 70, 72. Each of the webs of the first end beam can thus be welded to the corresponding webs of the I-beams of the side beams 70, 72. Bracing beams 76, 78 are welded between the side beams 70, 72 and the first end beam 74 within the U and near the first end of the base frame to form the U-shaped portion 68 into an open-centered, rigid structure upon which the winches 38, 40 can be placed. The open-centered structure of the base frame 24 provides top-to-bottom communication through the base frame 24 for a purpose to be discussed below.

Triangular points, 80 and 82, are welded to the first and second side beams, 70 and 72 respectively, at the top 26 of the base frame 24 and equidistantly between the ends 30, 32 of the base frame 24. As shown in FIG. 3, the pointers are welded to the side beams 70, 72 at the interior sides of the legs of the U formed by the side beams 70, 72 and serve to locate the center line 54 of the base frame 24 for a purpose to be discussed below.

The base frame 24 preferably further comprises a second end beam 84, having a length substantially equal to the length of the first end beam 74, which can be pinned to the side beams 70, 72 at the open end of the U to extend between the side beams 70, 72 at the second end 32 of the base frame 24. For this purpose, a circularly apertured plate 86 is welded to the central, upper and lower webs of the I-beam of the second side beam 72 and extends therefrom, substantially parallel to the second end 32 of the base frame 24, toward the first side beam 70. The plate 86 is shown in cross section in FIG. 3 and, as shown therein, the aperture 88 through the plate 86 is formed along a line parallel to the sides 34 and 36 of the base frame 24. A similar circularly apertured plate 90 is similarly welded to the first side beam 70.

Figure 4:
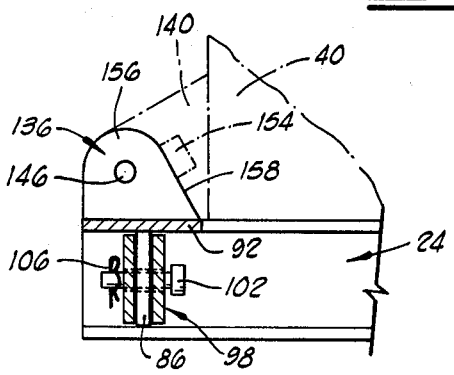
FIG. 4 is a partial cross section of a portion of one end of the assembled base frame taken along line 4—4 of FIG. 3.
Figure 5:
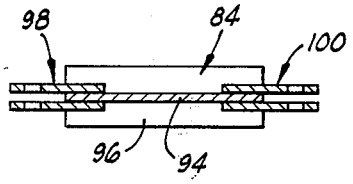
FIG. 5 is a cross section in plan view of the second end beam of the base frame.
Figure 5:
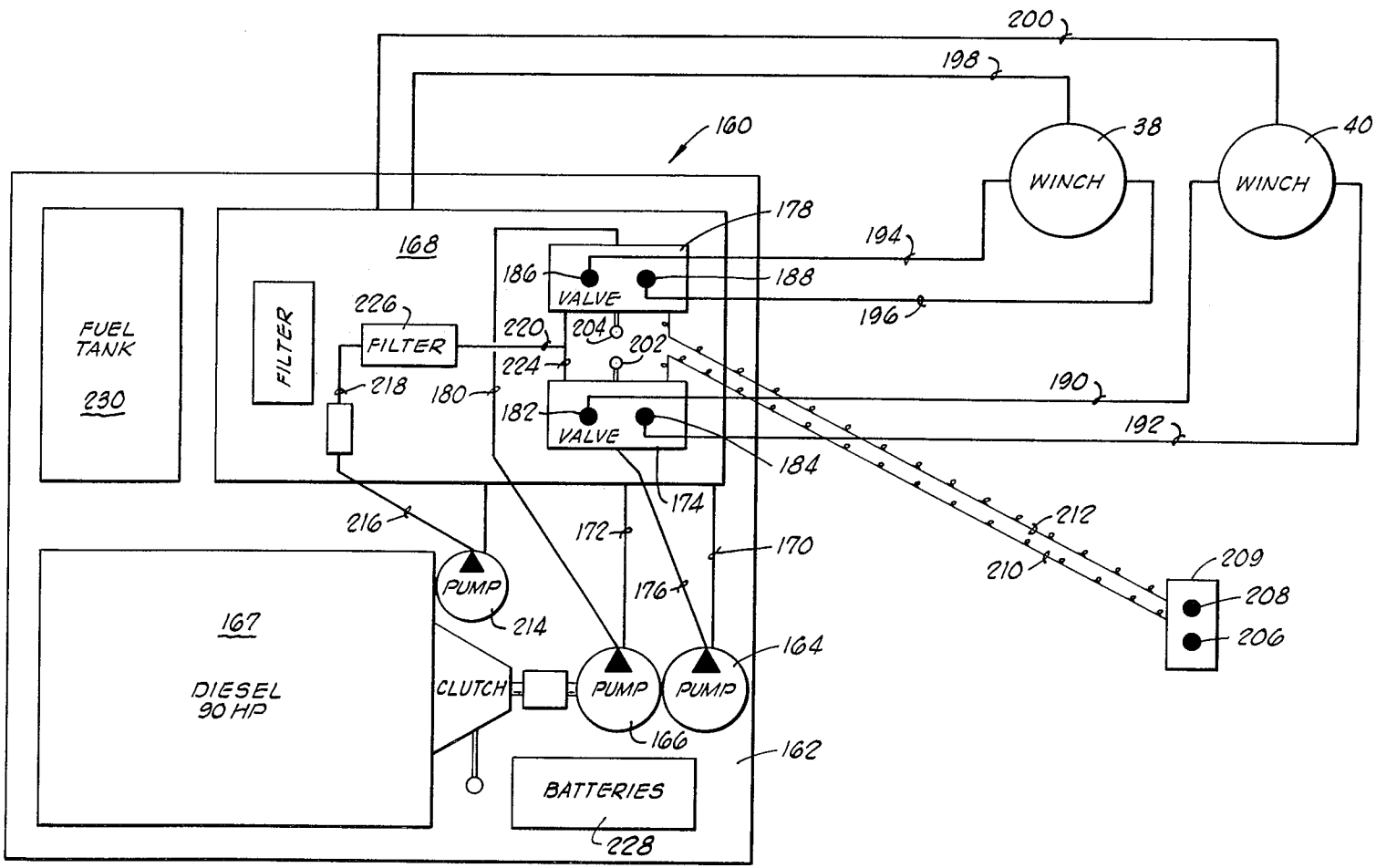

The construction of the second end beam 84 is shown in FIGS. 3 and 5 and the connection of the second end beam 84 to the second side beam 72 as shown in FIG. 4. (FIG. 4, which illustrates a portion of the base frame 24 as indicated by the line 4—4 of FIG. 3, has been drawn for the assembled base frame 24. That is, FIG. 4 shows portions of the second end beam 84 mounted on the portion 68 of the base frame 24.) As shown in FIGS. 3 and 5, the second end beam 84 is a length of I-beam having an upper web 92, which extends along the length of the second end beam 84, and central and lower webs, 94 and 96 respectively, which extend only along central portions of the second end beam 84.

FIG. 5 is a cross section of the second end beam 84 along a line parallel to the upper and lower webs 94 and 96 thereof and substantially equidistant therefrom. The limitation of the web 94 and 96 to only central portions of the second end beam 84 permits the second end beam 84 to be positioned on the U-shaped portion 68 of the base frame 24 such that the ends of the upper web 92 of the second end beam 84 rest on the plates 86 and 90, as shown for the plate 86 in FIG. 4, and the ends of the central web 94 abut the ends of the plate 86 and 90. As shown in FIGS. 3 and 5, the second end beam 84 further comprises two pairs, 98 and 100, of circularly apertured plates which are welded to opposite ends of the central web 94 of the second end beam 84 and extend therefrom to the ends of the second base beam 84. The plates forming the plate pairs 98, 100 are spaced to engage opposite sides of the plates 86 and 90 on the side beams 70 and 72 and the apertures (not numerically designated in the drawings) formed through the pairs 98 and 100 are positioned to align with the apertures through the plates 86 and 90 respectively when the second end beam 84 is positioned on the U-shaped portion 68 of the base frame 24 as described above. The base frame 24 further comprises two pins 102 and 104 and the second end beam 84 is mounted on the portions 68 of the base frame 24 by positioning the second end beam 84 on the portion 68 as described above, inserting pin 102 through plate 86 and plate pair 98 as has been shown in FIG. 4, and similarly inserting pin 104 through plate 90 and plate pair 100. Spring clips, such as the spring clip 106 shown in FIG. 4, can be inserted through holes (not shown) in the ends of pins 102 and 104 to prevent dislodgement of the pins 102 and 104 from the plates 86 and 90 and plate pairs 98 and 100. The second end beam 84 thus provides the base frame 24 with additional rigidity without interfering with the generally open-centered structure of the base frame 24 provided by the open-centered structure of the U-shaped portion 68 thereof. Moreover, the second end beam 86 can be removed from the U-shaped portion 68 of the base frame 24 to permit positioning of the base frame 24 about a drill pipe or the like as will be discussed below.

In the preferred embodiment of the present invention, the first winch attachment assembly 42 comprises two first clevis forming members 108 and 110 welded to the top of the base frame 24 adjacent the first end 30 thereof as has been shown in FIGS. 1, 2 and 3. The first clevis forming member 108 is conveniently attached to the first side beam 70 and the second clevis forming member 110 is conveniently attached to the second side beam 72. The clevis forming members 108 and 110 are identical in construction so that it will suffice for purposes of the present disclosure to describe only the first clevis forming member 108 with reference to FIGS. 1, 2 and 3. As shown in these figures, the clevis forming member 108 comprises a pair of plates 112 and 114 which are welded in a spaced apart, parallel relation to the top of the base frame 24 and extend substantially perpendicularly therefrom so as to form therebetween an opentopped and open-ended slot 116 extending longitudinally of the base frame 24. The plates 112 and 114 are identical and, as shown for the plate 112 in FIG. 1, the inner edges of the plates 112 and 114; that is the edges thereof farthest from the first end 30 of the base frame 24, are formed on a downward slope toward the center of the base frame 24. (The inner edge of plate 112 has been designated by the numeral 118 in FIGS. 1 and 2.) The purpose of so forming these inner edges will be discussed below. Circular apertures 120 and 122 (see FIG. 3) are formed along a common axis 124 through the plates 112 and 114, said common axis 124 extending perpendicularly to the plates 112 and 114 and parallel to the first end 30 of the base frame 24.

The clevis forming member 110 similarly comprises a pair of apertured plates (not numerically designated in the drawings) which are identical to the plates 112 and 114 so as to form an open-topped, open-ended slot therebetween and, as indicated in FIG. 3, the apertures in the plates of the clevis forming member 110 are similarly centered on the axis 124. The first winch attachment assembly 42 further comprises two planar first lugs 126 and 128 (FIGS. 1 and 2) which are welded to the first winch 38 and positioned thereon so that the lug 126 extends into the slot 116 between the plates 112 and 114 of the first clevis forming member 108 and the lug 128 similarly extends between the plates of the first clevis forming member 110 at such times that the first winch 38 is disposed in the preselected position thereof on the base frame 24. Circular apertures (not shown) are formed through the lugs 126, 128 to align with the apertures in the plates of the first clevis forming members 108, 110 when the first winch 38 is in such preselected position on the base frame 24. The first winch attachment assembly 42 further comprises two first pins, 130 and 132, which are inserted through the clevis forming members, 108 and 110 respectively, and through the planar first lugs 126 and 128 respectively, in the assembled condition of the apparatus 10, to pin, and thereby secure, the first winch 38 to the base frame 24 in the preselected position of the first winch 38. Dislodgement of the pins 130, 132 from the clevis forming members 108, 110 and from the lugs 126, 138 can be prevented by means of spring clips (not shown) in the same manner that spring clips are used to prevent dislodgement of the pins 102 and 104 utilized to connect the second end beam 84 of the base frame 24 to the U-shaped portion 68 thereof.

The second winch attachment assembly 44 similarly comprises: two clevis forming members, referred to herein as second clevis forming members and designated by the numerals 134 and 136 in FIGS. 1, 2 and 3, and which are welded to the top 26 of the base frame 24; and two planar lugs, referred to herein as second lugs and designated in FIGS. 1 and 2 by the numerals 138 and 140 and which are welded to the second winch 40. The second clevis forming members 134, 136 are identical to the first clevis forming members 108, 110 and, like the first clevis forming members 108, 110, are welded to the side beams 70 and 72 respectively. The second clevis forming member 134 is oriented on the base frame 24 such that the slot between the plates thereof is aligned with the slot 116 between the plates 112 and 114 of the first clevis forming member 108 and further oriented such that the downwardly sloping edges of the plates the second clevis forming member 134 are the inner edges thereof with respect to the base frame 24 as has been shown in FIG. 1. The second clevis forming member 136 is similarly oriented with respect to the first clevis forming member 110 and with respect to the base frame 24. The planar second lugs 138 and 140 are, similarly, identical to the planar first lugs 126 and 128 and are welded to the second winch 40 in positions to mesh with the second clevis forming members, 134 and 136 respectively, when the second winch 40 is in the preseleced position thereof on the base frame 24, in the same manner that the planar first lugs 126 and 128 mesh with the first clevis forming members, 108 and 110 respectively, when the first winch 38 is in the preselected position thereof on the base frame 24. As in the case of the plates of the first clevis forming members 108, 110, apertures (not numerically designated in the drawings) are formed through the plates of the second clevis forming members 134, 136 about an axis 142 which extends substantially parallel to the second end 32 of the base frame 24. Similarly, apertures (not shown) are formed through the second lugs 138 and 140 to align with the apertures in the plates of the second clevis forming members 134 and 136 when the second winch is in the preselected position thereof on the base frame 24. The second winch attachment assembly 44 further comprises two second pins 144 and 146 which can be inserted through the apertures formed through the second lugs 138 and 140 and through the apertures formed through the plates of the second clevis forming members 134 and 136, when the second winch 40 is in the preselected position thereof on the base frame 24, to pin, and thereby secure, the second winch 40 to the base frame 24 in the same manner that the first winch 38 is pinned to the base frame 24. Spring clips (not shown) can be used to prevent dislodgement of the pins 144, 146 as described above for the pins 130 and 132.

The apparatus 10 further comprises a plurality of guide plates 148, 150, 152 and 156 which are attached to the planar first lugs 126 and 128 and to the planar second lugs 138 and 140 as has been shown in FIG. 2. The positioning of the guide plates on the planar lugs has been shown in FIG. 4 for the guide plate 154. As noted above, each of the clevis forming members 108, 110, 134 and 136 comprises a pair of parallel plates which receive one of the planar lugs 126, 128, 138 and 140 therebetween when the winches 38 and 40 are disposed in the preselected positions thereof on the base frame 24. Moreover, the inner edges of the plates comprising each clevis forming member is provided with a downward slope toward the center line 54 of the base frame 24. In FIG. 4, the innermost plate of the clevis forming member 136; that is, the plate thereof farthest from the second side 36 of the base frame 24 (see FIG. 3), has been designated by the numeral 156 and the sloping inner edge of the plate 156 has been designated by the numeral 158. Moreover, a portion of the second winch 40, the planar second lug 140, and the guide plate 154 have been drawn in dot-dash lines in FIG. 4 to indicate the positioning of the planar second lug 140 and the guide plate 154, relative to the second clevis forming member 136, at such times that the second winch 40 is in the preselected position thereof on the base frame 24. The guide plate 154 is welded to one side of the planar second lug 140 so as to engage central portions of the downward sloping inner edge 158 of the plate 156 at such times that the second winch 40 is disposed in the preselected position thereof on the base frame 24. As has been indicated in FIG. 2, the guide plates 148, 150 and 152 are similarly each welded to one side of one of the planar lugs 126, 128 and 138 and the guide plates 148, 150 and 152 are similarly positioned on the lugs 126, 128 and 138 to engage central portions of the downward sloping inner edge of one of the plates of a clevis forming member at such times that the winches 38, 40 are in the preselected positions thereof on the base frame 24. The purpose of the guide plates 148, 150, 152 and 154 will be discussed below. (It will be clear from such discussion that each guide plate can be welded to either side of a planar lug so as to engage either of the plates of the clevis forming member into which such lug extends when the winches 38, 40 are in the preselected positions thereof on the base frame 24.)

As has been noted above, the winches 38, 40 are preferably hydraulically operated winches which require the transmittal of pressurized hydraulic fluid thereto for the turning of the reels, 46 and 48 respectively, thereof in either of the two possible directions of turning. FIG. 6 is a schematic diagram of a hydraulic circuit 160 suitable for turning the reels 46, 48 of the winches 38, 40. It is convenient to mount the hydraulic circuit 160 on a sled 162 which can be delivered, with the lifting apparatus 10, to a well site on a flatbed truck (not shown). The lifting apparatus 10 and the sled 160 can then be off-loaded, if desired, or the hydraulic circuit 160 can be operated from the truck. The hydraulic circuit 160 comprises two hydraulic pumps 164, 166 which are operated by a diesel engine 167 and which are each connected to one of the winches 38, 40 to provide pressurized hydraulic fluid thereto. The pumps 164 and 166 draw hydraulic fluid from a sump 168 via hydraulic conduits 170 and 172 respectively. The pump 164 then delivers pressurized hydraulic fluid to a valve 174 via a conduit 176 and the pump 166 similarly delivers pressurized hydraulic fluid to a valve 178 via conduit 180. Each of the valves 174 and 178 has two outlet ports, generally indicated at 182 and 184 for the valve 174 and at 186 and 188 for the valve 178, and the outlet ports of each of the valves 174 and 178 are connected to one of the winches 38 and 40. For example, as shown in FIG. 5, the outlet ports 182 and 184 can be connected to the second winch 40 via conduits 190 and 192 respectively and the outlet ports 186 and 188 can be connected to the first winch 38 via conduits 194 and 196 respectively. The valves 174 and 178 are constructed to selectively transmit pressurized hydraulic fluid to the winch connected thereto via one of the pairs of the conduits 190, 192 and 194, 196 and the winches 38, 40 are constructed such that the reel thereof will turn in a direction determined by the conduit via which the winch receives pressurized hydraulic fluid. Thus, for example, if pressurized hydraulic fluid is transmitted to winch 38 via conduit 194, the reel 46 of winch 38 will turn in one direction while the transmission of hydraulic fluid to winch 38 via conduit 196 will cause the reel 46 to turn in an opposite direction. Hydraulic fluid from the winches 38 and 40 is returned to the sump 168 via conduits 198 and 200 respectively.

The valves 174 and 178 are of the type which can be operated both manually and electrically to selectively transmit no hydraulic fluid; to transmit hydraulic fluid via a selected one of the outlet ports thereof; and to transmit hydraulic fluid via the other one of the outlet ports thereof and operating handles 202 and 204 are provided on the valves 174 and 178 respectively for such manual operation. Valves of this type are available from Bertea Industrial Products of Costa Mesa, Calif. A particularly suitable valve is identified by the Part No. C2Q27K. For electrical operation, the valves 174 and 178 are connected to a pair of switches 206 and 208 respectively via electrical conductors 210 and 212 respectively. Suitable switches for this purpose are Model 264360-21-H-C manufactured by Bertea Industrial Products of Costa Mesa, Calif. The switches can be operated to cause the valves 174 and 178 to operate as has been described above and are mounted on a portable chassis 209 so that the switches 206, 208 can be moved to various locations at the drilling site for a purpose to be discussed below. The valves 174 and 178 can be of the type that require auxiliary hydraulic pressure for operation thereof and, in such case, a pump 214 is provided to supply such auxiliary hydraulic pressure via conduits 216, 218, 220 and 224 and via a filter 226. (For example, the valves 174 and 178 can be of the type wherein the operating handles 202 and 204 or switches 206 and 208 actuate pilot valves which, in turn, actuate valve members to communicate the outlet ports of the valves with the conduits by means of which pressurized hydraulic fluid is supplied to the valves 174, 178. The Bertea valves, Part No. C2Q27K, are of this type.) For convenience, batteries 228 and a fuel tank 230 for the operation of the diesel engine 167 can be mounted on the sled 162 along with the pumps 164 and 166 and the sump 168.

OPERATION OF THE PREFERRED EMBODIMENT

The events that require the lifting of a blow-out preventer from the casing of an oil well occur only at intervals so that it is useful for one lifting apparatus 10 to service a number of drilling operations; the lifting apparatus 10 being available on call from operators of a drilling rig for this purpose. When a call is received, the lifting apparatus 10 and sled mounted hydraulic circuit 160 are moved to the site of the drilling rig by truck and the lifting apparatus is partially disassembled into the base frame 24, the first winch 38 and the second winch 40 for lifting to the drilling platform 12. Specifically, each of the winches 38, 40 is disconnected from the base frame 24 by removal of the pins 126, 128, 138 and 140 from remaining portions of the winch attachment assemblies 42 and 44 and the winches 38 and 40 are individually lifted to the drilling platform 12 by any suitable means. The base frame 24 is similarly lifted to the drilling platform 12 and, if desired, the sled 162 can be off-loaded from the truck used to deliver the apparatus 10 and hydraulic circuit 160 to the drilling rig.

Once the disassembled lifting apparatus 10 has been moved to the drilling platform 12, the base frame 24 is centered on the aperture 20 through the rotary table 16 as has been indicated in FIG. 2. In some cases, lifting of the blow-out preventer will be necessary when a drill pipe or the like, such as has been indicated at 22 in FIG. 2, extends through the blow-out preventer and is supported by a traveling block above the drilling platform 12. When such is the case, the pins 102 and 104, which secure the second end beam 84 of the base frame 24 to the U-shaped portion 68 thereof, are removed to permit positioning of the U-shaped portion 68 about the pipe 22. The second end beam 84 is then repositioned on the U-shaped portion 68 with each of the plate pairs 98 and 100 receiving one of the apertured plates 86 and 90 therebetween and the pins 102 and 104 are inserted through the apertures in the plates 86 and 90 and the plates forming the plate pairs 98 and 100 to reassemble the base frame 24.

As will be clear from the description of the construction of the base frame 24 above, the base frame 24 forms only a relatively light-weight portion of the apparatus 10 so that the base frame 24 can be easily moved about on the drilling platform 12 by sliding the base frame 24 on the drilling platform 12. Such ease of movement permits the base frame 24 to be substantially centered on the aperture 20 through the rotary table 16 and the pointers 80 and 82 provide a convenient means for gauging the longitudinal centering of the base frame 24 on the rotary table 16. (It has been found that lateral centering of the base frame 24 can be adequately gauged without the use of pointers.)

Once the base frame 24 has been centered on the aperture 20, the apparatus 10 is assembled by lifting the winches 38 and 40 by any suitable mechanism and lowering the winches into the preselected positions thereof on the base frame 24. As the winches 38, 40 are lowered into position, the guide plates 148, 150, 152 and 154 on the planar lugs 126, 128, 138 and 140 each engage the upper portion of the inner edge of one of the plates comprising the clevis forming members 108, 110, 134 and 136 so that the guide plates 148, 150, 152 and 154 slide down such inner edges to guide the winches 38, 40 into the preselected positions thereof on the base frame 24 as the winches 38, 40 move downwardly to the top 26 of the base frame 24. The pins 130, 132, 144 and 146 are then reinserted through the lugs 126, 128, 138 and 140 respectively and through the clevis forming members 108, 110, 134 and 136 respectively to pin, and thereby secure, the winches 38 and 40 to the base frame 24 in the preselected positions of the winches 38 and 40 on the base frame 24.

As is shown in FIG. 2, the positioning of the base frame 24 on the rotary table 16 and subsequent assembly of the apparatus 10 positions one side of each of the reels, opposite the indirect connection of the winches 38, 40 to the base frame 24, above the aperture 20 through the rotary table 16. Moreover, the cables 56 and 58 on the reels 46, 48 are positioned for movement substantially vertically through the aperture 20 and the flanges 60 and 62, on the reel 46, and the flanges 64 and 66, on the reel 48, confine cables 56 and 58 to movement through the aperture 20.

Following assembly of the apparatus 10 on the rotary table 16, the valves 174, 178 of the hydraulic circuit are operated to turn the reels 46, 48 in a direction to lower free ends of the cable 56, 58 toward the aperture 20 of the rotary table 16. Since the base frame 24 is open-centered as has been discussed above and since the base frame 24 has been centered above the aperture 20, the cables 56 and 58 will pass through the center of the base frame 24 and through the aperture 20 in the rotary table 16 to the blow-out preventer. The cables 56, 58 are provided with suitable connectors; for example, clevises (not shown) for attaching the cables 56, 58 to the blow-out preventer and such attachment is preferably at upper portions of the blow-out preventer. Once the cables have been attached to the blow-out preventer, the valves 174, 178 can be operated to take up slack in the cables 56, 58 and the blow-out preventer can be unbolted from the casing of the oil well. Thereafter, the valves 174 and 178 can be operated to raise and lower the blow-out preventer as required by the particular job at hand.

As will be clear from FIG. 2 and the above description of the apparatus 10, the axis 50 of the reel 46 of the first winch 38 is disposed between the axis 124 about which the first winch 38 is pinned to the base frame 24 via the first attachment assembly 42 and the aperture 20 through the rotary table 16. Accordingly, as a portion of the weight of the blow-out preventer is lifted by the reel 46, such portion of the weight of the blow-out preventer will tend to pivot the first winch 38 about the axis 124 to force the first winch 38 into tight engagement with the top 26 of the base frame 24. Similarly, the portion of the weight of the blow-out preventer lifted by the second winch 40 will tend to pivot the second winch 40 about the axis 142 of the second attachment assembly 44 to similarly pivot the second winch 40 into tight engagement with the top 26 of the base frame 24. The positioning of each of the winches 38, 40 to one side of the center line 54 of the base frame 24 places the line of force between the blow-out preventer and the reels 46, 48 within the central portions of the base frame 24 so that the lifting of the blow-out preventer will have no tendency to cause any tipping of the apparatus 10. In particular, in some cases it may be possible to lift the blow-out preventer utilizing only one of the winches 38, 40 and, should such be the case, the positioning of each of the winches to one side of the center line 54 prevents any instability of the apparatus 10 on the drilling platform 12. The stable characteristics of the apparatus 10 arising from the placement of the winches 38, 40 on the base frame 24 is a safety feature in that, should one of the cables 56, 58 break so that the other cable is subjected to the entire weight of the blow-out preventer, no possibility exists that such sudden transfer of the load on the apparatus 10 to one of the winches 38, 40 will cause a displacement or tipping of the apparatus 10 on the drilling platform 14. (In order to minimize the danger of breakage of the cables 56, 58, such cables are selected to have a breaking strength considerably larger than the weight of a blow-out preventer. However, it will be clear that it is desirable to provide for such eventuality.)

It will be noted that the attachment of the cables to upper portions of the blow-out preventer disposes the center of mass of the blow-out preventer below the points to which the cables are attached thereto. This location of the attachment points, made possible by the above-described construction of the apparatus 10, coupled with the placement of the apparatus 10 on top of the drilling platform, directly above the blow-out preventer, at such time that the apparatus 10 is utilized to lift a blow-out preventer, thus overcomes the serious safety problems associated with prior art blow-out preventer lifting systems. The lifting apparatus 10 is in a stable position with respect to forces it will experience during the suspension of the blow-out preventer and the blow-out preventer is in a state of stable equilibrium while suspended.

As has been noted above, the valves 174, 178 can be operated either manually, via the handles 202, 204, or electrically, via the switches 206, 208. In many cases, it will be convenient to leave the sled 162 on the truck which delivers the apparatus 10 and the hydraulic circuit 160 to the well site and, if such be the case, the operator of the valves 174, 178 may not have a clear view of the position of the blow-out preventer in relation to the drilling plaform 12. In such a case, the switches 206, 208 are carried to a location adjacent the blow-out preventer and the valves 174, 178 are operated electrically at such location by an operator who will, accordingly, be in a position to observe the effects of his manipulation of the switches 206, 208.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An on-site assemblable apparatus for lifting a load located beneath the drilling platform of a drilling rig, said platform having an aperture formed therethrough providing communication between spaces disposed above and below the drilling platform, comprising:

a base frame supportable by the drilling platform and positionable thereon with respect to the aperture formed through the drilling platform, said base frame having a top, a bottom and opposed first and second ends, and said base frame characterized as having an open-centered structure providing top-to-bottom communication through central portions thereof;

a first winch disposed on the top of the base frame at a preselected position adjacent one end of the base frame; and first winch attachment means for pinning the first winch to the base frame in said preselected position of the first winch, the first winch attachment means comprising:

a plurality of clevis forming members attached to the top of the base frame adjacent said one end of the base frame, each clevis forming member comprising a pair of spaced, substantially parallel plates;

a plurality of planar lugs attached to the first winch, each lug extending between the plates of one of the clevis forming members in the preselected position of the first winch, wherein apertures are formed through the plates of the clevis forming members and through the planar lugs, said apertures positioned such that the apertures through the plates of each clevis forming member align with the aperture through the lug disposed therebetween in the preselected position of the first winch; and a plurality of pins, each pin extending through the apertures formed through the plates of one of the clevis forming members and extending through the aperture formed through one of the lugs to secure the first winch in a preselected position thereof atop the base frame.

2. The apparatus of claim 1 wherein the base frame comprises:

a first side beam extending between the first and second ends of the base frame;

a second side beam extending between the first and second ends of the base frame, the second side beam being disposed substantially parallel to the first side beam and laterally spaced a distance from the first side beam; and a first end beam connected to the first side beam and the second side beam and extending therebetween along the first end of the base frame.

3. The apparatus of claim 2 wherein the base frame further comprises:

a second end beam connected to the first side beam and the second side beam and extending therebetween along the second end of the base frame.

4. The apparatus of claim 3 wherein the second end beam is connected to the first and second side beams by pinning the second end beam to the side beams.

5. The apparatus of claim 2, 3 or 4 further comprising:

a first pointer attached to the first side beam and extending toward the second side beam, said first pointer being located substantially equidistantly between the first and second ends of the base frame at the top of the base frame; and a second pointer attached to the second side beam and extending toward the first side beam, said second pointer being located substantially equidistantly between the first and second ends of the base frame at the top of the base frame.

6. The apparatus of claim 1 wherein a guide plate is affixed to one side of each lug; and wherein one of the plates of each clevis forming member is provided with a downwardly sloping edge to engage one of the guide plates, in central portions of such edge, at such times that the first winch is disposed in the preselected position thereof.

7. The apparatus of claim 1 wherein the first winch is positioned adjacent the first end of the base frame and wherein the apparatus further comprises:

a second winch disposed on the top of the base frame at a preselected position adjacent the second end of the base frame; and second winch attachment means for pinning the second winch to the base frame in said preselected position of the second winch, the second wind attachment means comprising:

a plurality of second clevis forming members attached to the top of the base frame adjacent the second end of the base frame, each second clevis forming member comprising a pair of spaced, substantially parallel plates;

a plurality of planar second lugs attached to the second winch, each second lug extending between the plates of one of the second clevis forming members in the preselected position of the second winch, wherein apertures are formed through the plates of the second clevis forming members and through the planar second lugs, said apertures positioned such that the apertures through the plates of each second clevis forming member align with the apertures through the second lug disposed therebetween in the preselected position of the second winch; and a plurality of second pins, each second pin extending through the apertures formed through the plates of one of the second clevis forming members and extending through the aperture formed through one of the second lugs to secure the second winch in the preselected position thereof atop the base frame.

8. The apparatus of claim 7 wherein a guide plate is affixed to one side of each first lug and each second lug; wherein one of the plates of each first clevis forming member and each second clevis forming member is provided with a downwardly sloping edge to engage one of the guide plates, in central portions of the edge, at such times that the first and second winches are disposed in the preselectedd positions thereof.

9. The apparatus of claim 7, 1 or 8 wherein the base frame comprises:

a first side beam extending between the first and second ends of the base frame;

a second side beam extending between the first and second ends of the base frame, the second side beam being disposed substantially parallel to the first side beam and laterally spaced a distance from the first side beam; and a first end beam connected to the first side beam and the second side beam and extending therebetween along the first end of the base frame.

10. The apparatus of claim 9 wherein the base frame further comprises:

a second end beam connected to the first side beam and the second side beam and extending therebetween along the second end of the base frame.

11. The apparatus of claim 10 wherein the second end beam is connected to the first and second side beams by pinning the second end beam to the side beams.

12. A method for lifting a blow-out preventer located beneath the drilling platform of a drilling rig, said platform including an open-centered rotary table, comprising the steps of:

placing an open-centered frame on the rotary table;

moving said frame to substantially align the center of the frame with the center of the rotary table;

mounting a plurality of winches on the frame;

passing cables from the winches through the frame and through the rotary table to the blow-out preventer;

connecting the cables to the blow-out preventer; and operating the winches to lift the blow-out preventer.

13. The method of claim 12 wherein the step of placing an open-centered frame on the rotary table comprises the steps of:

placing an open-ended portion of the frame on the rotary table with the center of the rotary table disposed between side members of said portion of the frame; and pinning an end beam to the open end of said open-ended portion of the frame.

14. The method of claim 12 or 13 wherein the step of mounting a plurality of winches on the frame comprises the steps of:

placing each winch in a preselected position on the frame; and pinning each winch to the frame to secure each winch in a preselected position thereof atop the frame.

15. A method for lifting the blow-out preventer of an oil well, said blow-out preventer disposed beneath an opened centered rotary table mounted in the drilling platform of a drilling rig used to drill the well, comprising the steps of:

positioning two winches having reels upon which cables are wound on the drilling platform on opposite sides of the rotary table such that the reels of the winches are substantially parallel;

fixing the relative positions of the winches;

passing the cables from the winches through the center of the rotary table to the blow-out preventer;

connecting the cables to the blow-out preventer; and operating the winches to lift the blow-out preventer.

* * * * *

UNITED STATES PATENT AND TRADEMARK OFFICE

CERTIFICATE OF CORRECTION

PATENT NO. : 4,305,467

DATED : December 15, 1981

INVENTOR(S) : Douglas R. Villines

It is certified that error appears in the above–identified patent and that said Letters Patent are hereby corrected as shown below:

In column 14, line 61, the word "preselectedd" should be --preselected--.

In column 14, line 62, the numerial "1" should be deleted.

Signed and Sealed this

*Fifteenth* Day of *June 1982*

[SEAL]

*Attest:*

GERALD J. MOSSINGHOFF

*Attesting Officer*

*Commissioner of Patents and Trademarks*